US009330799B1

(12) United States Patent
Phillips

(10) Patent No.: US 9,330,799 B1
(45) Date of Patent: May 3, 2016

(54) GARMENT FOR PROTECTION FROM ULTRAVIOLET RADIATION

(71) Applicant: D. Bruce Phillips, Miami, FL (US)

(72) Inventor: D. Bruce Phillips, Miami, FL (US)

( * ) Notice: Subject to any disclaimer, the term of this patent is extended or adjusted under 35 U.S.C. 154(b) by 0 days.

(21) Appl. No.: 14/618,780

(22) Filed: Feb. 10, 2015

(51) Int. Cl.
*G21F 3/02* (2006.01)
*G21F 1/10* (2006.01)

(52) U.S. Cl.
CPC ... *G21F 3/02* (2013.01); *G21F 1/10* (2013.01)

(58) Field of Classification Search
CPC ... A41D 13/08; A41D 13/1218; A41D 19/00; A41D 19/0041; A41D 19/015; A41D 1/04
USPC ..... 2/16, 123, 125, 126, 160, 167, 171, 2/271, 60, 84
See application file for complete search history.

(56) References Cited

U.S. PATENT DOCUMENTS 5,056,157 A 10/1991 Pryor
5,142,704 A * 9/1992 Viemeister ..... A41D 13/1218 2/171
5,357,633 A * 10/1994 Rael ..... A41D 13/08 2/126
5,628,062 A * 5/1997 Tseng ..... A41D 13/08 2/16
5,784,720 A * 7/1998 Mellon ..... A41D 19/0041 2/123
6,029,278 A * 2/2000 Lopez ..... A41D 13/08 2/16
6,539,550 B1 * 4/2003 Flores ..... A41D 13/08 2/159
6,775,844 B1 * 8/2004 Castillo ..... A41D 13/08 2/16
6,952,838 B1 * 10/2005 Gillette ..... A41D 15/002 2/159
7,926,120 B2 * 4/2011 Birmingham ..... A41D 13/1209 2/51
D649,293 S 11/2011 Lyons
D675,381 S 1/2013 Rambo
2009/0019612 A1 * 1/2009 Schulein ..... F41H 1/02 2/2.5
2009/0019616 A1 * 1/2009 Smith ..... A41D 13/02 2/51
2009/0019622 A1 * 1/2009 Mayfield ..... A41D 13/1209 2/455
2010/0024088 A1 * 2/2010 Griefer ..... A41D 13/08 2/16
2012/0054940 A1 * 3/2012 Halseth ..... A41D 27/18 2/69
2012/0255094 A1 * 10/2012 Dragony ..... A41D 13/08 2/16

FOREIGN PATENT DOCUMENTS

EP 1754420 A2 2/2007
KR 100819426 B1 4/2008

* cited by examiner

*Primary Examiner* — David A Vanore
(74) *Attorney, Agent, or Firm* — Albert Bordas, P.A.

(57) ABSTRACT

A garment for protection from ultraviolet radiation, having a torso garment with a front side and a rear side that extend from a first edge to an end. Further having first and second lateral sides and first and second shoulder sections. Extending from the first and second lateral sides and the first and second shoulder sections are first and second sleeves. First and second hand covers extend from the first and second sleeves respectively. The first and second hand covers each have an elastic band. The elastic band, a distal end, and third and fourth lateral sides define an interior face. The interior face has a thumb loop and at least first and second finger loops. The elastic band, the distal end, and the third and fourth lateral sides also define an exterior face.

17 Claims, 3 Drawing Sheets

GARMENT FOR PROTECTION FROM ULTRAVIOLET RADIATION

BACKGROUND OF THE INVENTION

1. Field of the Invention

The present invention relates to garments, and more particularly, to garments for protection from ultraviolet radiation.

2. Description of the Related Art

Skin cancer is a cancer that starts in the skin. Some other types of cancer start in other parts of the body and can spread to the skin, but these are not skin cancers. There are two main types of skin cancers, keratinocyte cancers, and melanomas. Basal and squamous cell skin cancers are by far the most common cancers of the skin. They start in cells called keratinocytes, the most common cells in the skin. Melanomas are cancers that develop from melanocytes. The cells that make the brown pigment that gives skin its color. Melanocytes can also form benign growths called moles.

There are other types of skin cancers as well, but they are much less common. They include merkel cell carcinoma, kaposi sarcoma, cutaneous lymphoma, skin adnexal tumors, and various types of sarcomas. However, together, these types account for less than 1% of all skin cancers.

Exposure to ultraviolet (UV) radiation is a major risk factor for most skin cancers. Sunlight is the main source of UV rays. People who get a lot of UV exposure from the sun are at greater risk for skin cancer. Even though UV rays make up only a very small portion of the sun's rays, they are the main cause of the sun's damaging effects on the skin. UV rays damage the DNA of skin cells. Skin cancers start when this damage affects the DNA of genes that control skin cell growth.

There are three main types of UV rays. UVA rays age skin cells and can damage their DNA. These rays are linked to long-term skin damage such as wrinkles, but they are also thought to play a role in some skin cancers. UVB rays can directly damage skin cells' DNA, and are the main rays that cause sunburns. They are also thought to cause most skin cancers. Lastly, UVC rays don't get through our atmosphere and are not in sunlight. They are not normally a cause of skin cancer. Both UVA and UVB rays damage skin and cause skin cancer. UVB rays are a more potent cause of at least some skin cancers, but based on what's known today, there are no safe UV rays.

The amount of UV exposure a person gets depends on the strength of the rays, the length of time the skin is exposed, and whether the skin is protected with clothing or sunscreen. Skin cancers are one result of getting too much sun, but there are other effects as well. Sunburn and tanning are the short-term results of too much exposure to UV rays, and are signs of skin damage. Long-term exposure can cause early skin aging, wrinkles, loss of skin elasticity, dark patches, and pre-cancerous skin changes.

Applicant believes that one of the closest references corresponds to U.S. Patent Application Publication No. 20120255094 A1, published on Oct. 11, 2012 to Victor Dragony for sun screen article. However, it differs from the present invention because Dragony teaches a sun screen article protecting at least an arm and a shoulder, and optionally a portion of the neck and/or a portion of the hand of a person wearing it from excessive exposure to solar radiation, and method of using the sun screen article inside a vehicle. The article includes a tubular portion adapted to protect an arm and a flap adjoining the tubular portion and adapted to protect a shoulder. An optional collar portion affixed to the open and of the flap is structured to screen at least a portion of the neck. An epaulette, in affixable cooperation with the flap of the sun screen article, prevents a shoulder harness from freely moving with respect to the sun screen article and a body of the sun screen article from sliding down the arm of the wearer.

Applicant believes that another reference corresponds to U.S. Patent Application Publication No. US 20100024088 A1, published on Feb. 4, 2010 to Shannon Griefer for UV protected arm sleeves. However, it differs from the present invention because Griefer teaches an arm sleeve comprising an upper arm portion, a lower arm portion, and a pocket, wherein the arm sleeve provides protection against harmful ultraviolet rays. The arm sleeve may be made out of spandex or a combination of spandex and any one or more of bamboo, polyester, nylon, hemp, maize, lyocell, or other wood pulp based fabric, or other synthetic or natural knitted or woven fabric. The arm sleeve may also have a fastener to attach two or more arm sleeves together.

Applicant believes that another reference corresponds to U.S. Pat. No. 6,775,844 B1 issued to Patrick Castillo on Aug. 17, 2004 for arm shades. However, it differs from the present invention because Castillo teaches a health apparatus for use by individuals while driving. The health apparatus would be an arm shield, which would be worn over an individual's "outside arm" while driving. The arm shield would reduce sun exposure on the arm and would be attached via two end-mounted elastic bands. An extra hood could be wrapped around the individual's hand on the outside arm for added protection.

Applicant believes that another reference corresponds to U.S. Pat. No. 6,539,550 B1 issued to Barbara Flores on Apr. 1, 2003 for a set of driving gloves. However, it differs from the present invention because Flores teaches a set of three driving gloves, each having a different length to be worn by a driver. Each glove has a varying length with finger portions cut away to allow for greater flexibility when driving. The set includes a full length glove, a medium length glove, and a short glove.

Applicant believes that another reference corresponds to U.S. Pat. No. 6,029,278 A issued to Guillermo Lopez on Feb. 29, 2000 for a sun protection device. However, it differs from the present invention because Lopez teaches a device for protecting the user while seated in a vehicle from the harmful effects of the sun. The sun protection device includes a headpiece, which may be a cap or headband, a face/neck cover for shielding the side of the user's face and directly exposed to the sun and a shoulder/arm cover for shielding the user's shoulder and arm directly exposed to sunlight. The device may further include a hand cover for the user's hand, which is most directly exposed to sunlight, as well as a second shoulder/arm cover for the side of the user's body indirectly exposed to the sun through other vehicle openings.

Applicant believes that another reference corresponds to U.S. Pat. No. 5,628,062 A issued to Li Ming Tseng on May 13, 1997 for an arm and hand UV protection sleeve for driving. However, it differs from the present invention because Tseng teaches an arm and hand ultra violet protection sleeve for driving that includes a special graded fabric sun-block sleeve for UV protection while driving. The UV-proof sleeve is constructed of special graded soft and smooth irritation free fabric material, and with an elongated air ventilating chamber-like cavity extended from the upper arm portion down to the wrist area and from the wrist, a cuff extends in arch over the back of the hand which ends over the tip of the fingers, and with fastening elements and openings to both ends, so that the sleeve can be held in place gently and worn comfortably while driving. The UV protection sleeve can effectively narrow down and reduce the chance of drivers contracting any type of skin damage or health hazardous skin diseases from the intrusion of ultra violet radiation.

Applicant believes that another reference corresponds to U.S. Pat. No. 5,357,633 A issued to George V. Rael on Oct. 25, 1994 for an arm protective garment. However, it differs from the present invention because Rael teaches an arm protective garment that includes an elongated tubular sleeve made of a flexible fabric and defining an elongated internal cavity extending between opposite ends. The sleeve is open at one end for slipping over a driver's hand and arm and for receiving the driver's arm in the internal cavity of the sleeve. The garment also includes a mitten of flexible fabric disposed on the other end of the sleeve and defining an internal pocket for receiving the driver's hand therein. The mitten has only a thumb opening defined therein for extension of the driver's thumb from the mitten. The garment further includes a flexible strap attached to the one open end of the sleeve for encircling the neck or chest of the driver for releasable reattachment to the one open end of the sleeve to retain the sleeve on the driver's arm.

Applicant believes that another reference corresponds to U.S. Pat. No. 5,056,157 A issued to Linda D. Pryor on Oct. 15, 1991 for a solar radiation protecting device and method. However, it differs from the present invention because Pryor teaches a solar radiation protecting device for protecting the forearm and perhaps a portion of an upper arm of an individual when the arm of that individual projects outwardly of a vehicle window while the passenger or driver is seated within the vehicle. This protective device will protect against excessive solar radiation exposure when the arm is so projected beyond the window of the vehicle and thereupon exposed to solar radiation. The protecting device comprises a flexible fabric covering which extends over at least a portion of the forearm of the individual and also permits air exposure to the skin while worn. Strap means are located on the flexible fabric covering for releasably securing the fabric covering to the forearm of the individual.

Applicant believes that another reference corresponds to U.S. Pat. No. D675,381 S issued to Patricia Rambo on Jan. 29, 2013 for a sun protective garment. However, it differs from the present invention because Rambo teaches a different design from that of Applicant.

Applicant believes that another reference corresponds to U.S. Pat. No. D649,293 S issued to Frank T. Lyons on Nov. 22, 2011 for an arm protector for blocking sunlight while driving. However, it differs from the present invention because Lyons teaches a different design from that of Applicant.

Applicant believes that another reference corresponds to EP Patent No. 1754420 (A2) issued to Draznin Elke on Feb. 21, 2007 for a sun protective sleeve for car driver. However, it differs from the present invention because Elke teaches a sleeve made of a light textile material for a comfortable feeling on a hot day and is designed as an ordinary sleeve provided with an extension covering the back of the hand. The upper end can also be provided with an extension in order to prevent the sleeve from exposing the shoulder of the user. The sleeve is available in various sizes.

Applicant believes that another reference corresponds to KR Patent No. 100819426 B1 issued to Sin Dong II on Apr. 4, 2008 for a sun cover for arm. However, it differs from the present invention because Sin Dong II teaches an arm cover for protecting an arm from the sunlight to achieve a smooth air circulation and a hygienic usage, and to allow a user to have a convenient wearing feeling. An arm cover for protecting an arm from a sunlight includes: an upper-arm covering unit, which is to be fastened to an upper arm of a user; and a forearm covering unit, which is to be fastened to his/her forearm. The upper-arm covering unit comprises: a first upper-arm covering member, having a shape corresponding to his/her upper arm; and a second upper-arm covering member, wrapping an outer surface of the first upper-arm covering member; as well as an air vent. The forearm covering unit comprises: a first forearm covering member, having a shape corresponding to his/her forearm; a second forearm covering member, wrapping an outer surface of the first forearm covering member; and a hand back covering member, having a film member, and connected to the first forearm covering member in a swiveled manner.

Other patents describing the closest subject matter provide for a number of more or less complicated features that fail to solve the problem in an efficient and economical way. None of these patents suggest the novel features of the present invention.

SUMMARY OF THE INVENTION

The instant invention is a garment for protection from ultraviolet radiation, comprising a torso garment having a front side and a rear side that extend from a first edge to an end. The torso garment further comprises first and second lateral sides and first and second shoulder sections. Extending from the first and second lateral sides and the first and second shoulder sections are first and second sleeves respectively. First and second hand covers extend from the first and second sleeves respectively. The first and second hand covers each comprise an elastic band. The elastic band, a distal end, and third and fourth lateral sides define an interior face. The interior face comprises a thumb loop and at least first and second finger loops. The elastic band, the distal end, and the third and fourth lateral sides also define an exterior face. The interior and exterior faces may fold internally within the first and second sleeves respectively, or may fold externally onto the first and second sleeves respectively. In a preferred embodiment, the elastic bands are sewn to the first and second hand covers. The thumb loop is positioned at a predetermined distance from the elastic band without reaching the distal end.

The torso garment further comprises securing means to secure a neck gaiter. The torso garment further comprises a neckband that extends from the first edge. The neckband may also comprise securing means to secure the neck gaiter. The securing means includes fasteners, spring snaps assemblies, hook and loop fasteners, and zipper assemblies. The securing means can be positioned at an interior or exterior side of the neckband. The spring snaps assemblies comprise caps, sockets, studs, and posts. The neck gaiter comprises an exterior side and an interior side that extend between a top end and a bottom end. The neck gaiter also comprises securing means to secure onto the neckband. The torso garment, first and second hand covers, and neck gaiter are made of stretchable fabrics/materials such as spandex, cotton, cotton blends, nylon, polyesters, and combinations thereof.

It is therefore one of the main objects of the present invention to provide a garment for protection from ultraviolet radiation that is easily worn on the upper torso of a user.

It is another object of this invention to provide a garment for protection from ultraviolet radiation that covers the back of a user's hands.

It is another object of this invention to provide a garment for protection from ultraviolet radiation that is versatile.

It is another object of this invention to provide a garment for protection from ultraviolet radiation that is volumetrically efficient.

It is another object of this invention to provide a garment for protection from ultraviolet radiation that is comfortable.

It is another object of this invention to provide a garment for protection from ultraviolet radiation that is durable.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
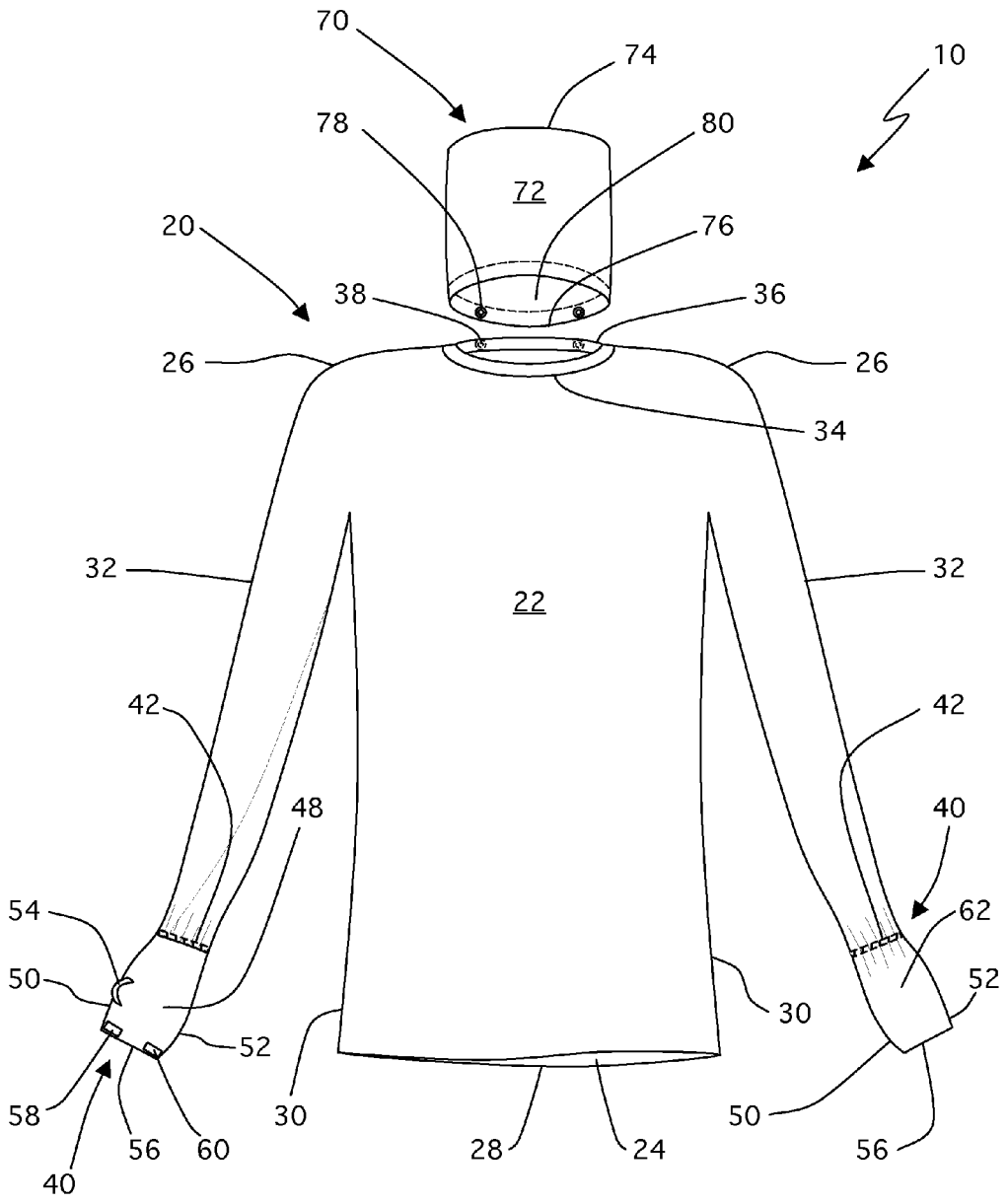
FIG. 1 is an isometric view of the present invention.

Referring now to the drawings, the present invention is a garment for protection from ultraviolet radiation and is generally referred to with numeral 10. It can be observed that it basically includes torso garment 20, hand covers 40, and neck gaiter 70.

Figure 2:
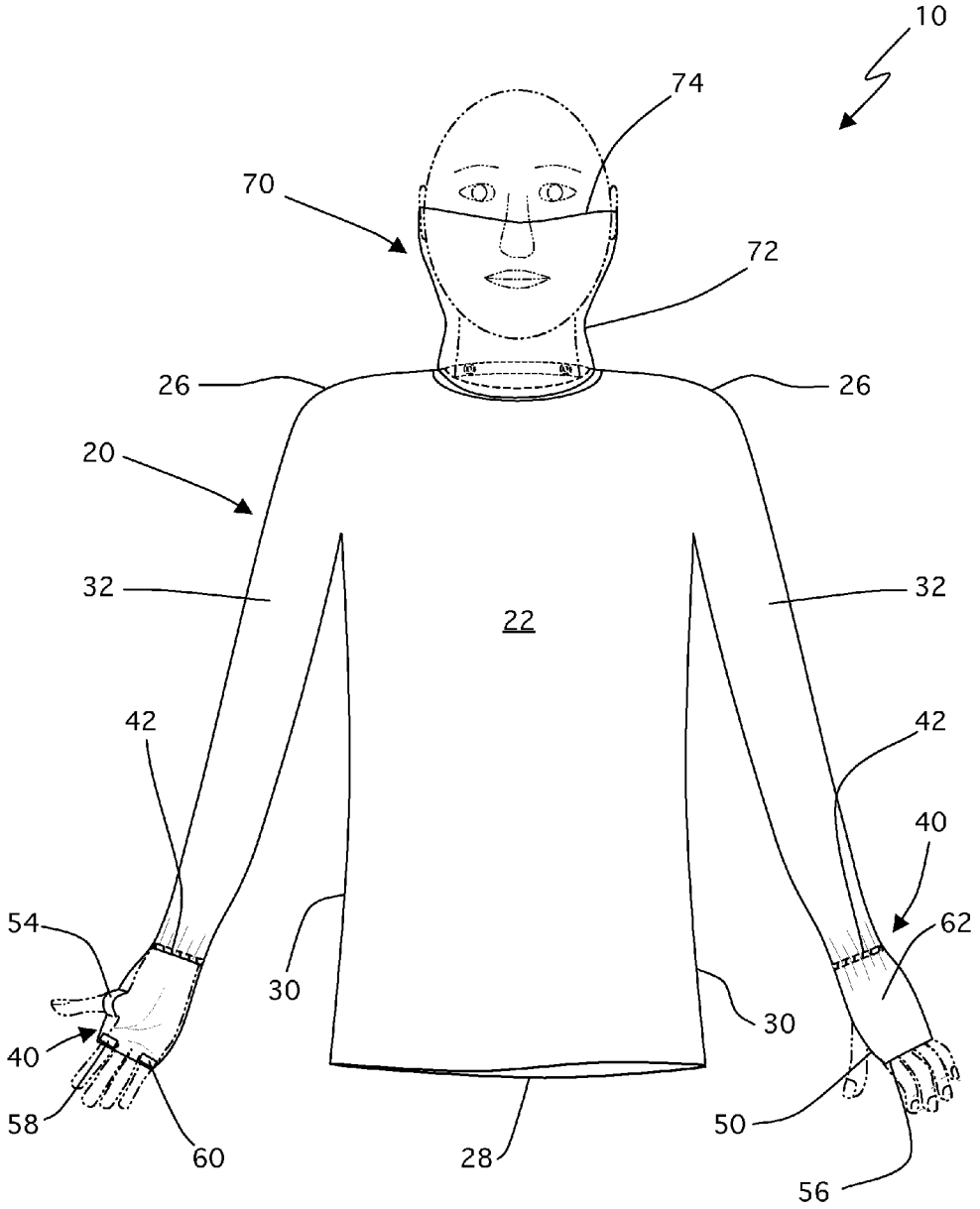
FIG. 2 is a first isometric view of the present invention as worn by a user.

As seen in FIGS. 1 and 2, torso garment 20 comprises front side 22 and rear side 24 that extend from edge 36 to end 28. Torso garment 20 further comprises lateral sides 30 and shoulder sections 26. Extending from lateral sides 30 and shoulder sections 26 are respective sleeves 32. Extending from each sleeve 32 is a respective hand cover 40.

Each hand cover 40 comprises elastic band 42. In a preferred embodiment, elastic band 42 snugly and comfortably fits at, or approximately at, a user's wrist section, whereby elastic band 42 is sewn thereon. Elastic band 42, distal end 56, and lateral sides 50 and 52 define interior face 48. Sewn onto interior face 48 is thumb loop 54. Thumb loop 54 is designed to receive a thumb of a user. In a preferred embodiment, thumb loop 54 is positioned at a first predetermined distance from elastic band 42 without reaching distal end 56. Also sewn onto interior face 48 are at least first and second finger loops 58 and 60. As seen for illustrative purposes, first and second finger loops 58 and 60 are designed to receive a right index and little finger respectively of the user. It is understood that the other illustrated hand cover 40 is designed for a left hand of the user. Elastic band 42, distal end 56, and lateral sides 50 and 52 also define exterior face 62 that is designed cover a back of the user's hand. In a preferred embodiment, present invention 10 is worn to fit the user so that only the user's fingers extend beyond distal end 56, and lateral side 50 being adjacent to the user's thumb.

In an alternate embodiment, each interior face 48 and/or exterior face 62 has semi-ridged properties so that it may fold internally within sleeve 32, or externally onto sleeve 32, at elastic band 42 to remain in place in the event the user wants to cover his/her arms but not the back of the hands.

Torso garment 20 may further comprise neckband 34 that extends to edge 36. Torso garment 20 may comprise securing means to secure neck gaiter 70. Such securing means may be positioned anywhere thereon, such as at rear side 24, or below or adjacent to neckband 34. In the illustrated embodiment, neckband 34 comprises the securing means to secure neck gaiter 70. Such securing means includes, but is not limited to fasteners, spring snaps assemblies, hook and loop fasteners, and zipper assemblies. For illustrative purposes, the securing means in this embodiment comprises female spring snap assemblies 38 that are positioned at neckband 34. Such spring snaps assemblies may comprise as an example caps, sockets, studs, and posts (eyelets). It is noted that the securing means may be positioned on either an interior or exterior side of neckband 34.

To further protect from UV radiation, present invention comprises neck gaiter 70. Neck gaiter 70 comprises exterior side 72 and interior side 80 that extend between top end 74 and bottom end 76. Neck gaiter 70 further comprises male spring snap assemblies 78 that are positioned at interior side 80. It is noted that the securing means at neck gaiter 70 may also be positioned at the exterior side 72. Furthermore, the male and female spring snap assemblies may be switched, the intension being that they connect/mate to function as securing means.

Figure 3:
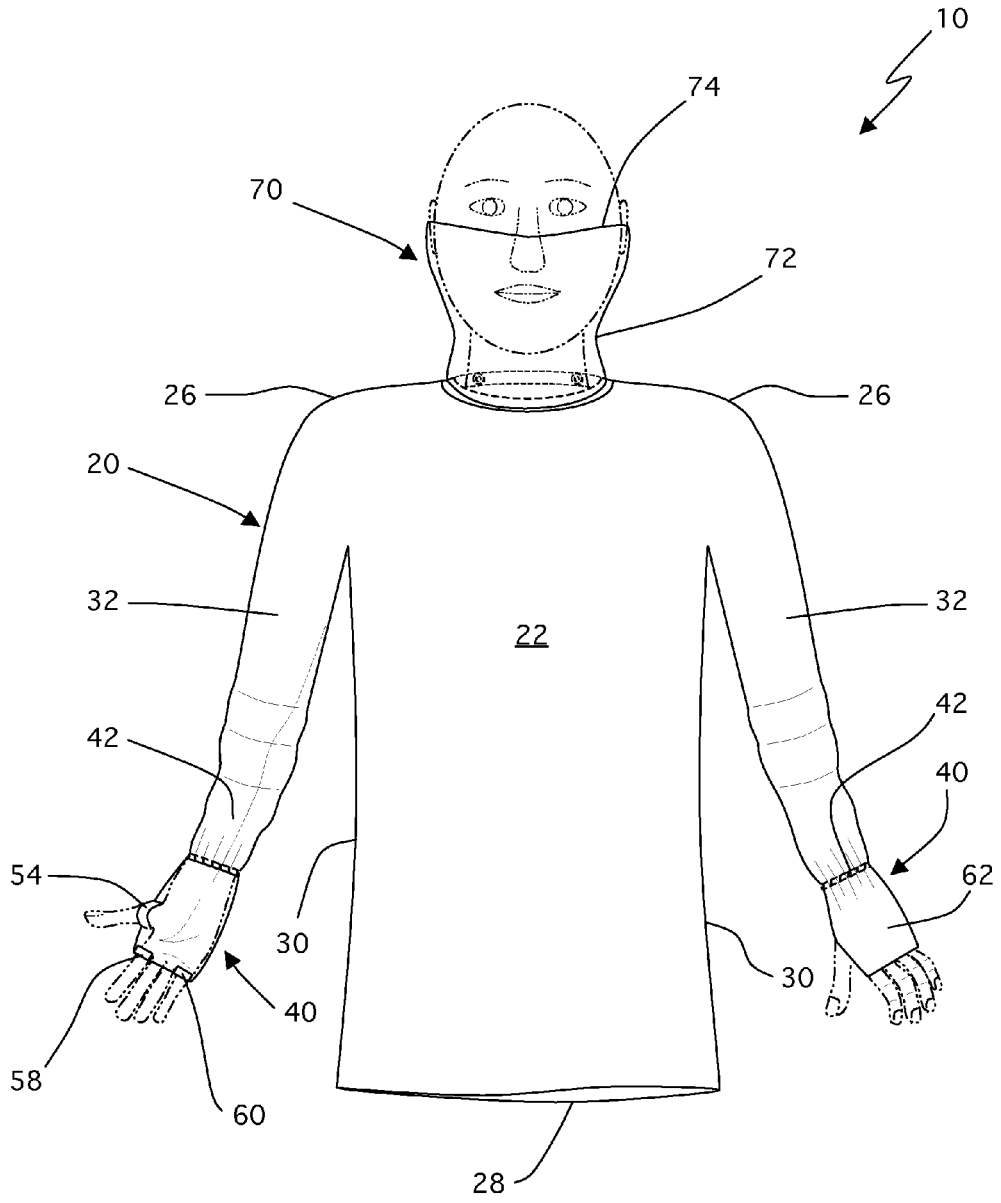
FIG. 3 is a second isometric view of the present invention as worn by a second user with shorter arms than that of the user illustrated in FIG. 2.

As seen in FIG. 3, present invention 10 is worn by a second user with shorter arms than that of the user illustrated in FIG. 2, whereby elastic band 42 snugly and comfortably fits at, or approximately at, a user's wrist section.

In a preferred embodiment, torso garment 20 and hand covers 40 are made of comfortable stretchable fabrics/materials so that thumb loop 54, and first and second finger loops 58 and 60 remain snug while worn by the user upon the thumb, index, and little finger respectively. In addition, neck gaiter 70 is also made of are made of comfortable stretchable fabrics/materials to snugly fit over the user's neck and onto a neck area of the user. Neck gaiter 70 is also sufficiently large and elastic to comfortably cover the ears, nose, and mouth if desired by the user. Such comfortable stretchable fabrics/materials include, but are not limited to spandex, cotton, cotton blends, nylon, polyesters, combinations thereof, or any other comfortable stretchable fabrics/materials having similar characteristics to said spandex, cotton, cotton blends, nylon, polyesters materials.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A garment for protection from ultraviolet radiation, comprising:

A) a torso garment comprising a front side and a rear side that extend from a first edge to an end, said torso garment further comprises first and second lateral sides and first and second shoulder sections, extending from said first and second lateral sides and said first and second shoulder sections are first and second sleeves respectively, said torso garment further comprises securing means to secure a neck gaiter, said securing means includes fasteners, spring snaps assemblies, hook and loop fasteners, and zipper assemblies; and B) first and second hand covers that extend from said first and second sleeves respectively, said first and second hand covers each comprise an elastic band, said elastic band, a distal end, and third and fourth lateral sides define an interior face, said interior face comprises a thumb loop and at least first and second finger loops.

2. The garment for protection from ultraviolet radiation set forth in claim 1, further characterized in that said elastic band, said distal end, and said third and fourth lateral sides also define an exterior face.

3. The garment for protection from ultraviolet radiation set forth in claim 2, further characterized in that each said interior and exterior faces may fold internally within said first and second sleeves respectively.

4. The garment for protection from ultraviolet radiation set forth in claim 2, further characterized in that each said interior and exterior faces may fold externally onto said first and second sleeves respectively.

5. The garment for protection from ultraviolet radiation set forth in claim 1, further characterized in that each said elastic band is sewn to said first and second hand covers respectively.

6. The garment for protection from ultraviolet radiation set forth in claim 1, further characterized in that said thumb loop is positioned at a predetermined distance from said elastic band without reaching said distal end.

7. The garment for protection from ultraviolet radiation set forth in claim 1, further characterized in that said torso garment further comprises a neckband that extends from said first edge, said neckband comprises securing means to secure a neck gaiter.

8. The garment for protection from ultraviolet radiation set forth in claim 1, further characterized in that said securing means are positioned at said neckband.

9. The garment for protection from ultraviolet radiation set forth in claim 7, further characterized in that said securing means are positioned at an interior side of said neckband.

10. The garment for protection from ultraviolet radiation set forth in claim 7, further characterized in that said securing means are positioned at an exterior side of said neckband.

11. The garment for protection from ultraviolet radiation set forth in claim 1, further characterized in that said spring snaps assemblies comprise caps, sockets, studs, and posts.

12. The garment for protection from ultraviolet radiation set forth in claim 1, further characterized in that said neck gaiter comprises an exterior side and an interior side that extend between a top end and a bottom end.

13. The garment for protection from ultraviolet radiation set forth in claim 1, further characterized in that said neck gaiter also comprises said securing means to secure onto said neckband.

14. The garment for protection from ultraviolet radiation set forth in claim 1, further characterized in that said torso garment and said first and second hand covers are made of stretchable fabrics/materials.

15. The garment for protection from ultraviolet radiation set forth in claim 14, further characterized in that said stretchable fabrics/materials include spandex, cotton, cotton blends, nylon, polyesters, and combinations thereof.

16. The garment for protection from ultraviolet radiation set forth in claim 1, further characterized in that said neck gaiter is made of stretchable fabrics/materials.

17. The garment for protection from ultraviolet radiation set forth in claim 16, further characterized in that said stretchable fabrics/materials include spandex, cotton, cotton blends, nylon, polyesters, and combinations thereof.

* * * * *